US007900552B2

(12) United States Patent
Schivalocchi et al.

(10) Patent No.: US 7,900,552 B2
(45) Date of Patent: Mar. 8, 2011

(54) PISTON FOR COLD CHAMBER DIE-CASTING MACHINE

(75) Inventors: Carlo Schivalocchi, Brescia (IT); Chiara Schivalocchi, Brescia (IT)

(73) Assignee: Copromec S.r.l., Roe' Volciano, Brescia (IT)

( * ) Notice: Subject to any disclaimer, the term of this patent is extended or adjusted under 35 U.S.C. 154(b) by 198 days.

(21) Appl. No.: 12/245,987

(22) Filed: Oct. 6, 2008

(65) Prior Publication Data

US 2009/0071326 A1 Mar. 19, 2009

Related U.S. Application Data

(63) Continuation of application No. PCT/IT2007/000255, filed on Apr. 4, 2007.

(30) Foreign Application Priority Data

Apr. 12, 2006 (IT) ..... BS2006A0087

(51) Int. Cl.
*F16J 1/00* (2006.01)
*F01B 31/08* (2006.01)

(52) U.S. Cl. ..... 92/255; 92/186

(58) Field of Classification Search ..... 92/155, 92/186, 255; 277/435, 445, 496–499
See application file for complete search history.

(56) References Cited

U.S. PATENT DOCUMENTS

| | | | | |
|---|---|---|---|---|
| 514,621 | A * | 2/1894 | Heggem | 92/155 |
| 3,212,411 | A * | 10/1965 | Storms | 92/155 |
| 4,886,107 | A | 12/1989 | Zecman | |
| 5,048,592 | A | 9/1991 | Mueller | |
| 5,233,912 | A * | 8/1993 | Mueller | 92/255 |
| 6,311,761 | B1 * | 11/2001 | Steininger et al. | 92/187 |
| 6,745,820 | B2 * | 6/2004 | Schivalocchi | 164/312 |
| 7,134,383 | B2 * | 11/2006 | Petersen et al. | 92/186 |

FOREIGN PATENT DOCUMENTS

| | | |
|---|---|---|
| EP | 1 197 279 A2 | 4/2002 |
| JP | 57-68257 | 4/1982 |
| WO | WO 03/074214 A1 | 9/2003 |

OTHER PUBLICATIONS

Notification of Transmittal of the International Search Report and the Written Opinion of the International Searching Authority for corresponding International Patent Application No. PCT/IT2007/000255 dated Sep. 11, 2007 (11 pages).

* cited by examiner

*Primary Examiner* — Michael Leslie
(74) *Attorney, Agent, or Firm* — Kilyk & Bowersox, P.L.L.C.

(57) ABSTRACT

The object of the present invention is a piston for cold chamber die-casting machines comprising a body and at least one sealing band mounted around said body, wherein said body and said band are provided with coupling means suitable for concurrently obtaining both an angular locking and an axial locking of the band to the piston body.

32 Claims, 14 Drawing Sheets

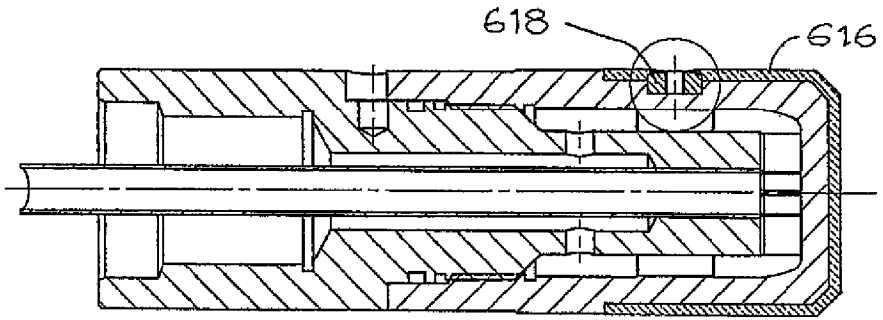
Fig. 16
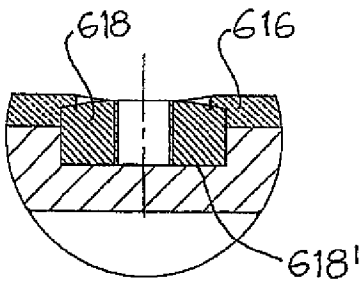
Fig. 16a
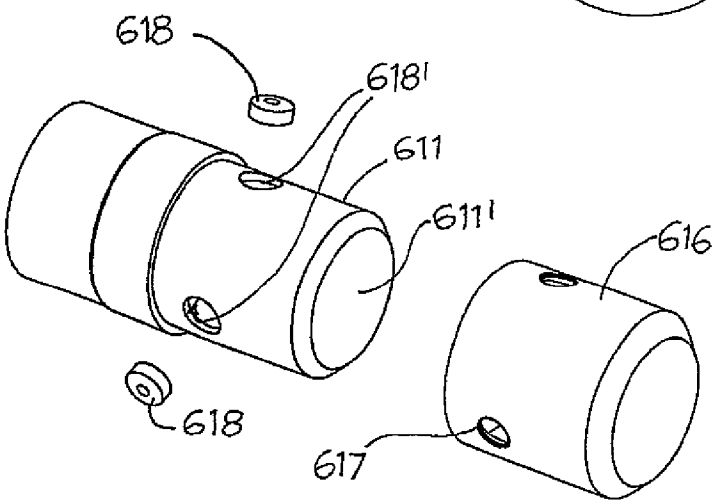
Fig. 16b
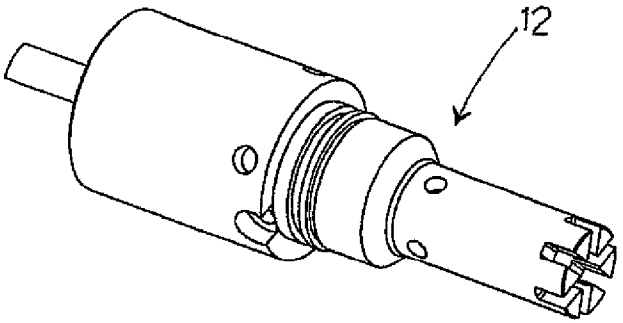

PISTON FOR COLD CHAMBER DIE-CASTING MACHINE

This application is a continuation of PCT/IT2007/000255, filed Apr. 4, 2007, which claims priority from Italian Patent Application No. BS2006A000087, filed Apr. 12, 2006.

FIELD OF THE INVENTION

The present invention relates to die-casting machines and in particular it refers to a piston of a press for cold chamber die-casting.

BACKGROUND ART

In cold chamber die-casting machines it is known to use injection pistons with a steel or copper body and at least one outer sealing band arranged astride of a collar at the piston head.

An example of such pistons is described in U.S. Pat. No. 5,233,912.

EP1197279, by the same applicant, describes a piston for cold chamber die-casting machines which comprises a steel body having a head with or without peripheral chamfer and at least one copper alloy sealing band arranged about the body in a respective seat obtained in retracted position relative to the head, and wherein on the outer piston surface comprised between the head and the band there are obtained at least two channels intended for placing the piston head in communication with the annular seat of the band for metal inflow underneath the band itself. In this way, by solidifying, the metal that flows into the seat creates a continuous thickening that radially pushes the band outwards, progressively recovering the wear thereof, adapting it to any deformations of the piston container and therefore protecting the latter.

However, it has been found that in all the known embodiments thereof, the sealing band tends to rotate on the piston making the operation thereof less effective.

In fact, all sealing bands have a split or interruption shaped as a step along the circumference that allows assembling the band on the piston and ensures certain radial expansion thereof. Especially in the assembly step, when the band is released, the elasticity thereof could cause settling in an unsuitable position that impairs the sealing thereof. For example, the band split should not be:

- facing the top side of the container, where fused aluminium exhibits greater fluidity (in fact, aluminium lays by gravity on the bottom portion, remaining in contact with the surface of the container and of the piston head for longer, losing a few temperature degrees);
- at the starting points of the casting branches, where metal at the liquid state has greater fluidity,
- at the mechanical interference points that could occur at the container openings (liquid metal loading inlet and casting channel starting points).

In an attempt to obviating such disadvantage, a piston having a radial pin and a sealing band has been proposed, which at the step-wise split or interruption exhibits a seat suitable for receiving said pin.

Such solution however makes the assembly of the band on the piston more difficult and in any case requires separate means for the axial and angular locking of the band.

SUMMARY OF THE INVENTION

The object of the present invention therefore is to propose a piston for cold chamber die-casting machines, which should allow obviating the disadvantage mentioned above in a safe and effective manner.

Another object of the invention is to provide a piston provided with means suitable for locking the sealing band in axial and angular direction at the same time.

Such objects are achieved with a piston according to claim 1.

BRIEF DESCRIPTION OF THE DRAWINGS

Further features and advantages of the piston according to the present invention will in any case appear more clearly from the following description, made with reference to the annexed indicative and non-limiting drawings, wherein:

FIGS. 16 and 16*b* show an axial section and an exploded perspective view of a piston in another embodiment; and FIG. 16*a* shows an enlarged view of the circled detail in FIG. 16.

DETAILED DESCRIPTION OF THE INVENTION

Figure 3:
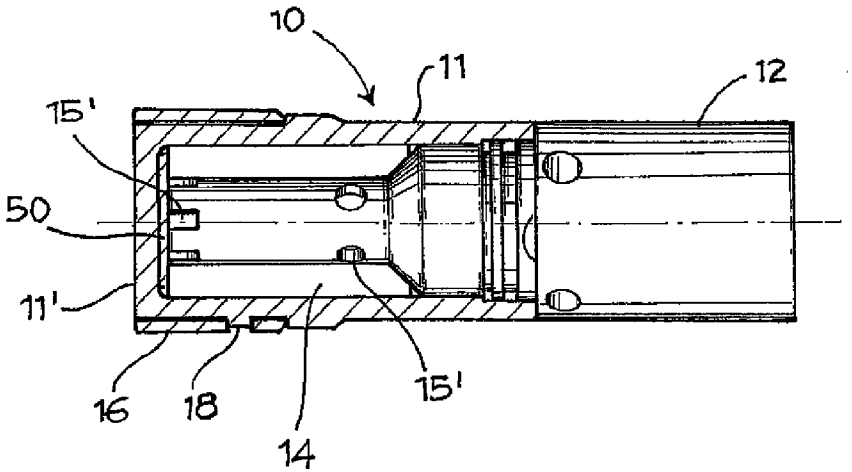
FIG. 3 shows a partial axial section view of the piston.

With reference to FIGS. 1-4, reference numerals 10, 110 denote a piston having a cylindrical body 11, 111, preferably of steel. The body ends at the front, or on the side pushing the fused metal, with a head 11', 111'.

Piston 10, 110 slides inside a container 60 of a press of a die-casting machine. Considering piston and container arranged horizontally, container 60 has, obtained in a top portion 2 and at an end thereof, an inlet 1 for loading the metal at the liquid state, for example aluminium. At the opposite end relative to inlet 1, container 60 has splits 3 corresponding to starting points of the casting branches.

In a preferred embodiment, said body 11 is mounted on a support plug 12. Plug 12 exhibits a front portion 13 of smaller diameter so that between it and body 11 there is defined a cooling chamber 14. Plug 12 is axially crossed by a duct 15 for a cooling fluid. Said duct 15 leads into chamber 14 through radial channels 15'.

Advantageously, between the front end of plug 12 and head 11' of body 11 of the piston there is arranged a copper pad 50 that contributes to increasing the cooling of said head 11', which is the piston portion that overheats more during use.

On the front portion of the piston body 11, in the proximity of head 11', there is mounted at least one sealing band 16, preferably of copper alloy.

According to the invention, each sealing band 16 and the piston comprise connecting means suitable for concurrently making an axial and angular locking of each band to the piston body 11.

In accordance with a preferred embodiment, at least two openings 17 are obtained in band 16 wherein respective radial projections 18 that extend from the piston body 11 engage. Advantageously, said openings 17 are shaped as slots and each radial projection 18 is configured as a circular sector.

Preferably, openings 17, and as a consequence the piston projections 18, are arranged symmetrically relative to the main axis X of the band and of the piston. Advantageously, if N is the number (greater than or equal to, two) of the openings and of the relevant projections, openings 17 and projections 18 are spaced from each other by equal angles $\alpha=360°/N$.

Preferably, openings 17 are through openings. However, projections 18 have a height not more than the band thickness, so as to not protrude from said openings and thus damage the container wherein piston 10 slides.

In accordance with a preferred embodiment, each opening 17 has a greater passage section than the cross section of projections 18. On the one side this facilitates the assembly and the expansion of the band following the penetration of metal thereunder; on the other side, it allows the excess liquid metal to escape through the openings of the band preventing the latter from being removed.

In particular, slots 17 have curved end portions 17' not occupied by the respective projections 18, which on the other hand have a substantially rectangular section.

Figure 1:
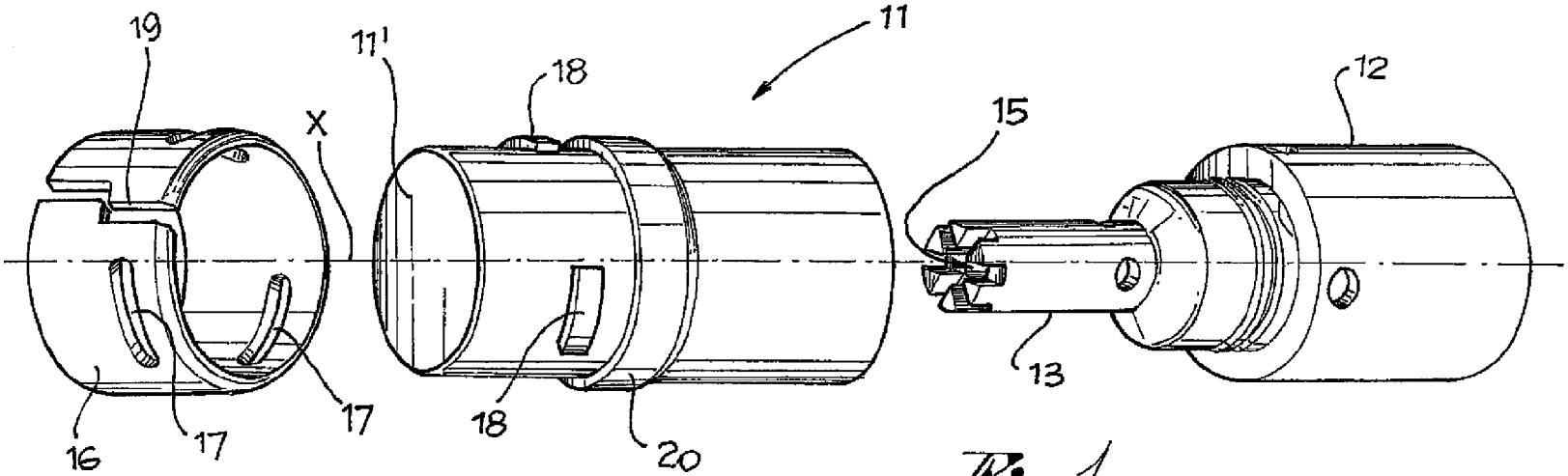
FIG. 1 shows an exploded view of the piston according to the invention.
Figure 2:
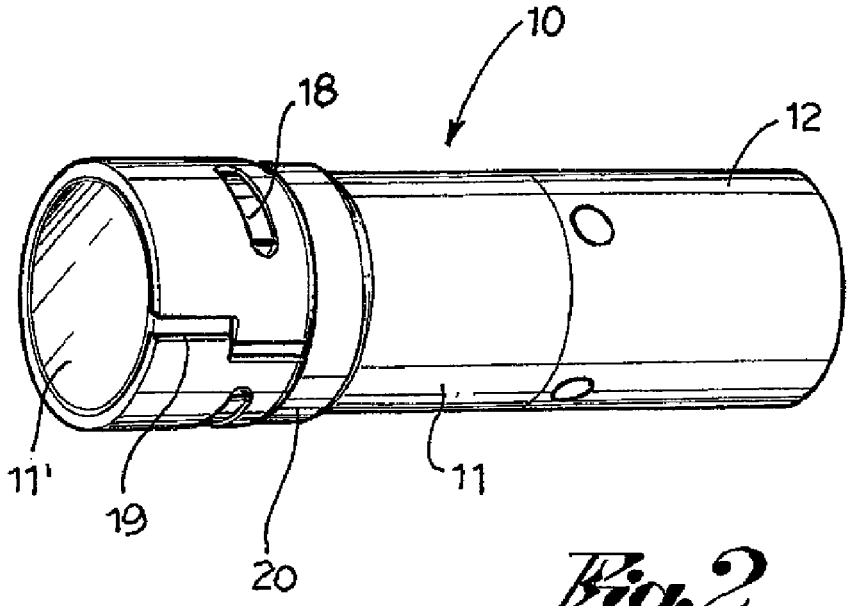
FIG. 2 shows the assembled piston.

In one embodiment illustrated in FIGS. 1-3, piston 10 is provided with a single sealing band 16 that extends starting from an annular stop shoulder 20 up to head 11' of body 11. Said stop shoulder 20 axially constrains band 16 during the forward movement of the piston. The axial locking of the band during the piston roll-back on the other hand, is guaranteed by the interaction between projections 18 and openings 17.

Figure 4:
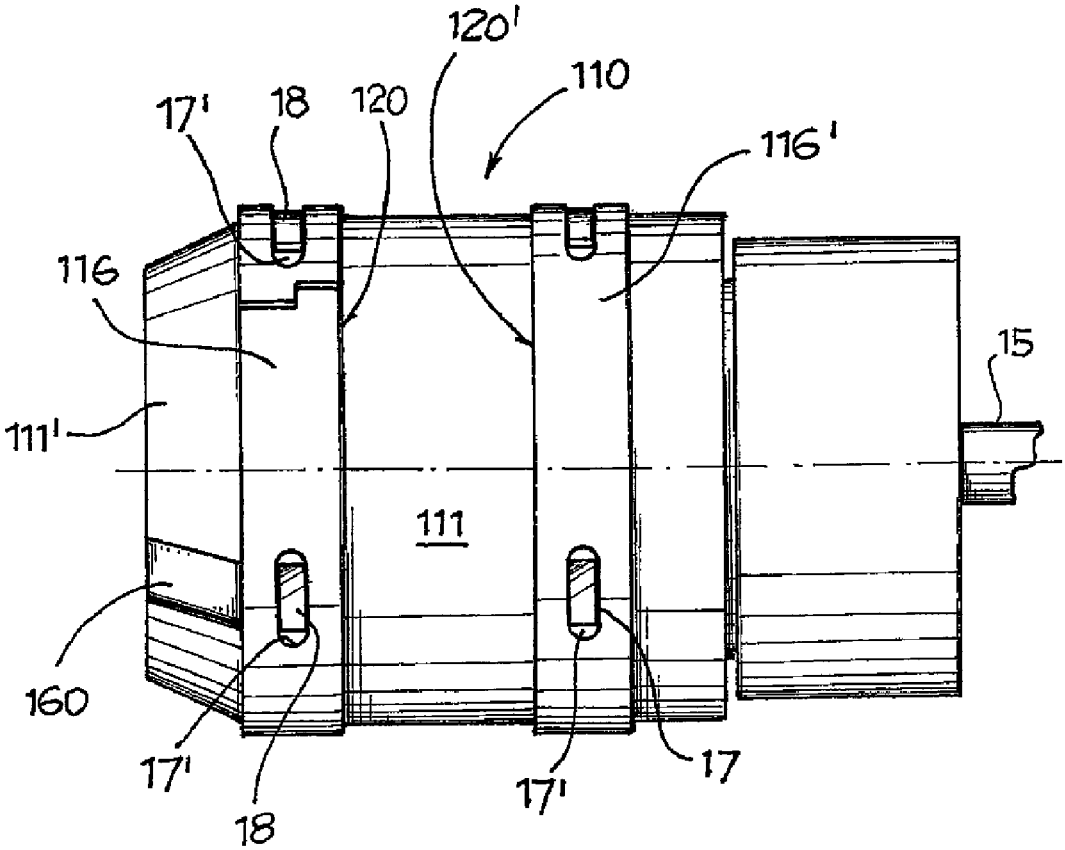
FIG. 4 shows an embodiment variation of the piston.

In one embodiment illustrated in FIG. 4, piston 110 is provided with two sealing bands 116, 116' located in respective seats 120, 120' obtained around body 111. As in the version described hereinbefore, bands 116, 116' are axially and angularly locked to body 111 by the coupling between radial projections 18 and openings 17.

Head 111' of body 111 has a peripheral chamfer.

Advantageously, on the outer surface of the piston body 111 comprised between head 111' and the band 116 that is closer thereto there are obtained at least two channels 160 that connect the bottom of seat 120 of the band to head 111' of the piston body. Through such channels, the fused metal can flow into seat 120 under band 116, so as to create a continuous thickening that compensates the thinning of the band due to the wear thereof as a consequence of the piston use and of the thermal deformations of the container thereof.

The piston therefore, keeps the seal and the efficiency longer irrespective of the level of wear of the copper alloy band.

Bands 16, 116, 116' have respective splits or interruptions 19, for example step-wise, suitable for allowing the band assembly on the piston body and, especially in the case of the embodiment described in FIG. 4, the expansion thereof subsequent to the inflow of the liquid metal into the seat under the band.

Figure 7:
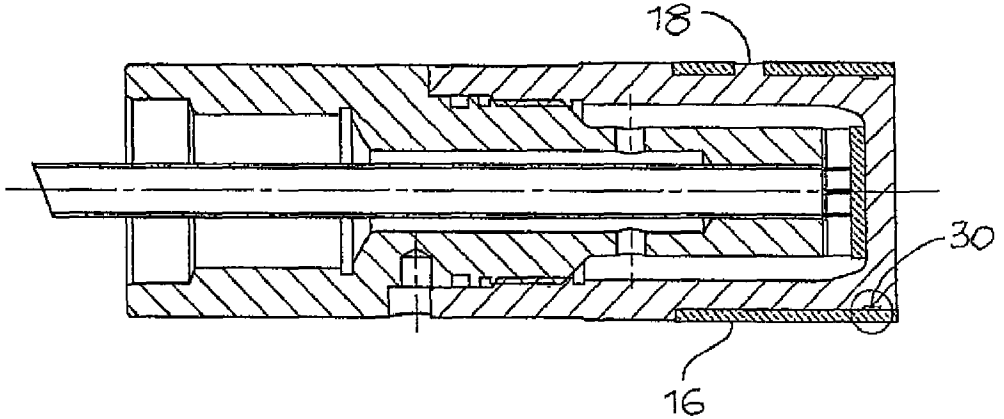
FIG. 7 shows an axial section view of the piston in another embodiment.
Figure 7A:
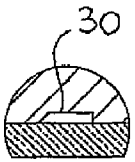
FIG. 7*a* shows an enlarged view of the circled detail in FIG. 7.
Figure 7B:
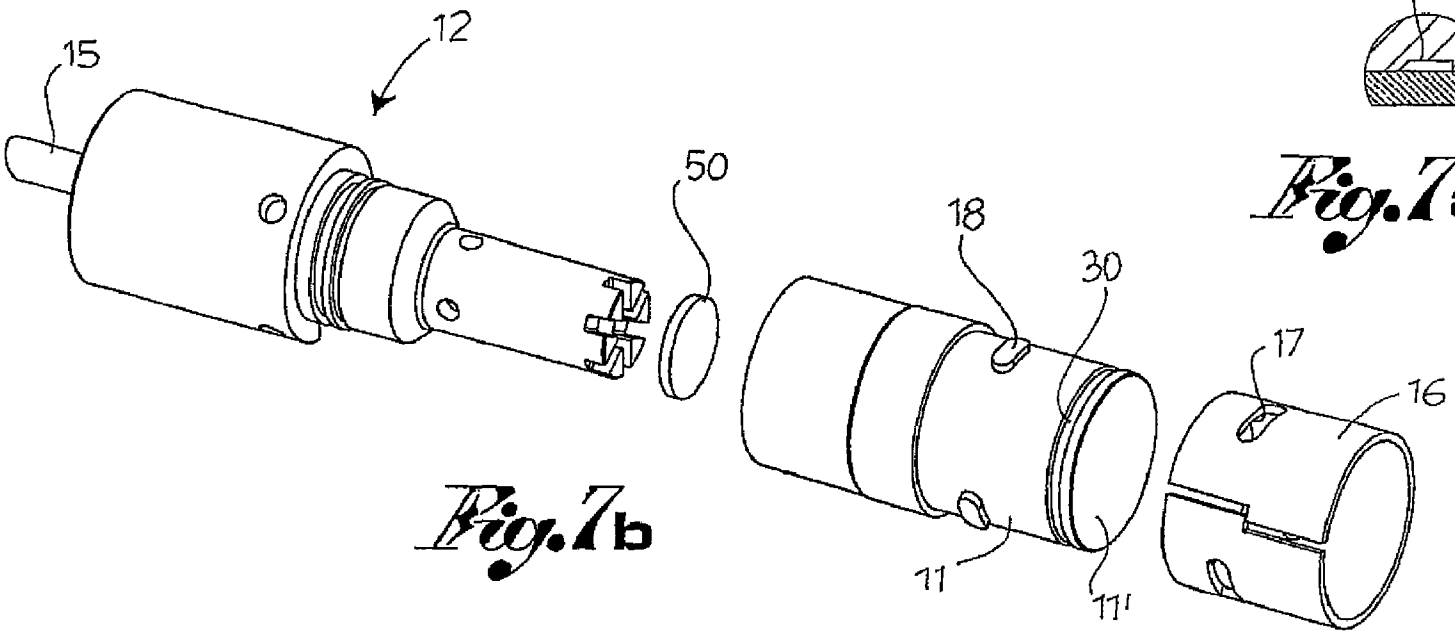
FIG. 7*b* shows an exploded perspective view of the piston of FIG. 7.

In accordance with one embodiment illustrated in FIGS. 7, 7*a* and 7*b*, the piston body 11 has, in the proximity of head 11', an annular channel 30. Such annular channel 30 is covered by the sealing band 16 when this is not fitted on body 11. The effect of channel 30 is to hold any metal that could introduce between band 16 and body 11, creating a thickening under band 16 when the metal solidifies that contributes to keeping the band seal on the walls of container 60 unchanged.

Figure 8:
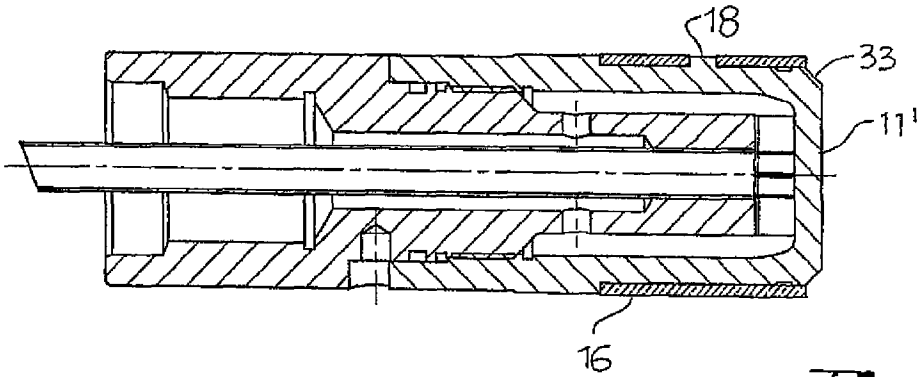
FIGS. 8 and 8*a* show an axial section and an exploded perspective view of a piston in another embodiment.
Figure 8A:
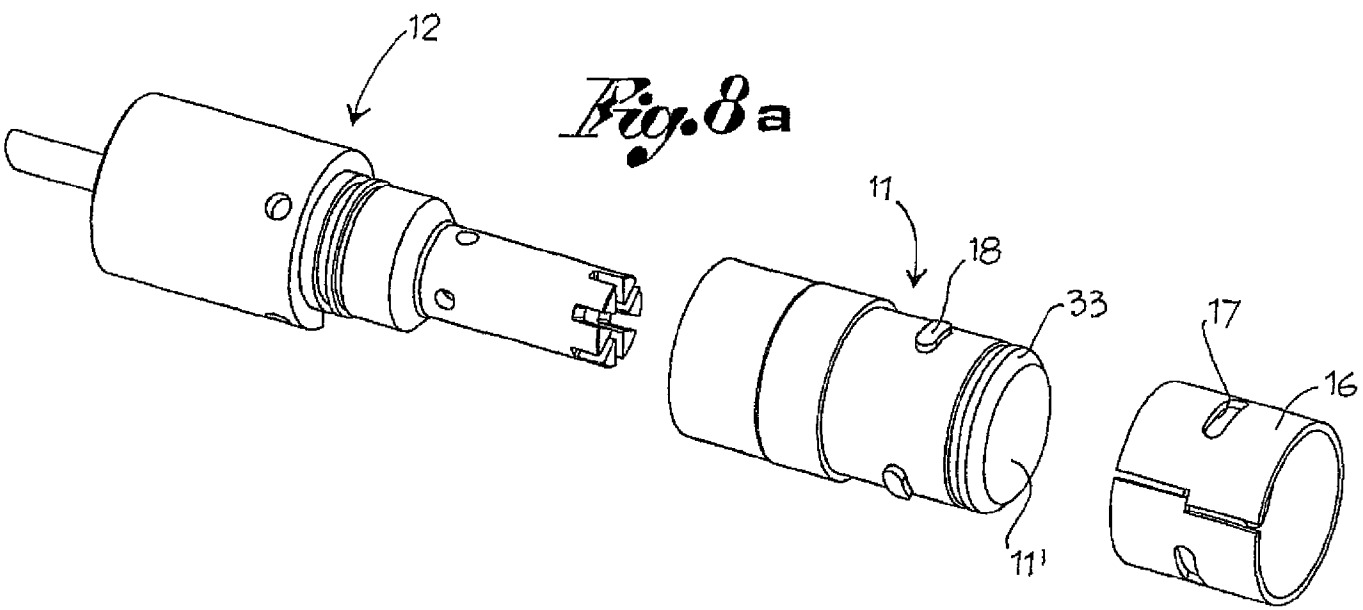

According to one embodiment illustrated in FIGS. 8 and 8*a*, the sealing band 16 does not end at the level of head 11' of the piston body 11, but remains in retracted position. In particular, band 16 links to head 11' by a conical surface 33. For example, such conical surface 33 is inclined by 45° relative to the piston axis.

Such embodiment solution allows lightening the feedhead thanks to the presence of a head 11'-33 of the piston that protrudes from the sealing band 16; moreover, the presence of such protruding head favours the detachment of the feedhead itself from the piston and protects the band from the heat produced by the metal at the liquid state.

It should be noted, always in the embodiment illustrated in FIGS. 8 and 8*a*, that band 16 has a symmetry relative to a cross axis, besides the main axis. In other words, openings 17 are obtained in intermediate position relative to the longitudinal extension of the band. This allows mounting the band on body 11 without distinction on both ends and, advantageously, reversing the band orientation when the portion thereof facing the piston head is worn.

Of course such device can be extended to all the embodiments of the piston described.

Figure 9:
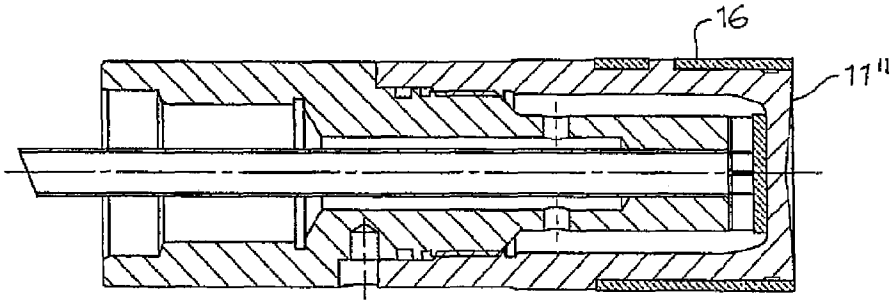
FIGS. 9 and 9*a* show an axial section and an exploded perspective view of a piston in another embodiment.
Figure 9A:
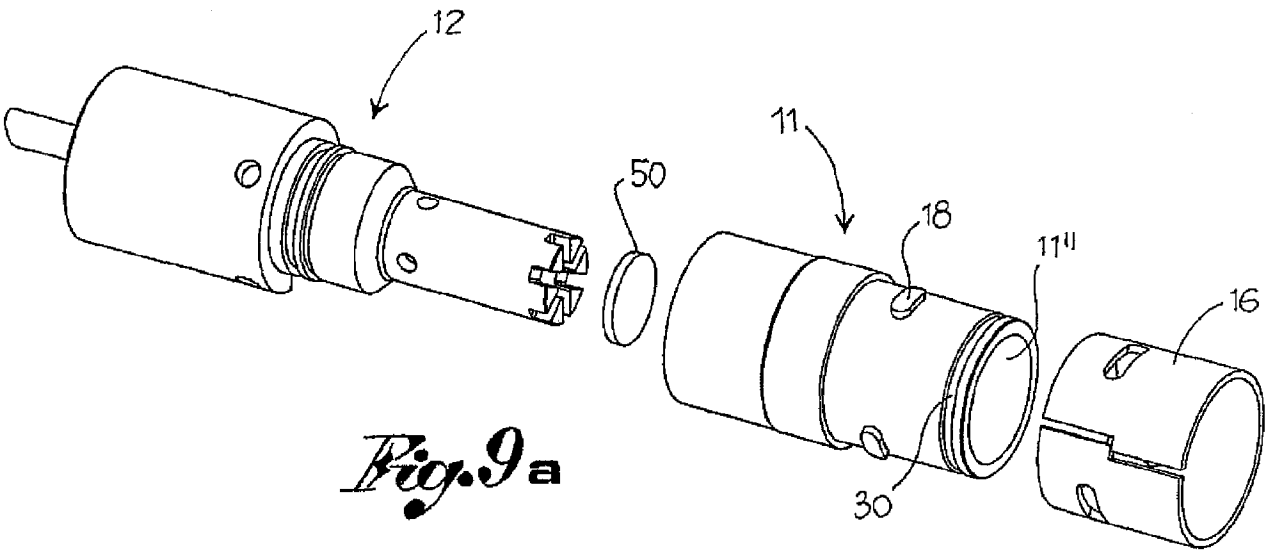

In one embodiment shown in FIGS. 9 and 9*a*, the piston body 11 has a concave head 11'. Such configuration of the head in the first place allows relieving the pressures exerted by the metal in the container towards the piston axis, thereby relieving the pressure on the peripheral zone where the sealing band is; in the second place, it has been proved that the feedhead separation is facilitated.

Figure 10:
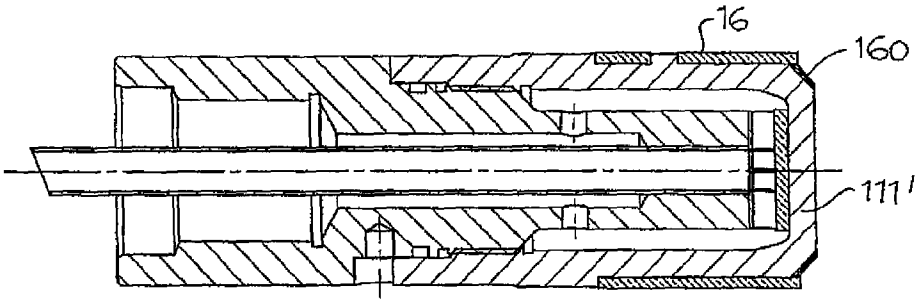
FIGS. 10, 10*a* and 10*b* show an axial section, a front view and an exploded perspective view of a piston in another embodiment.
Figure 10A:
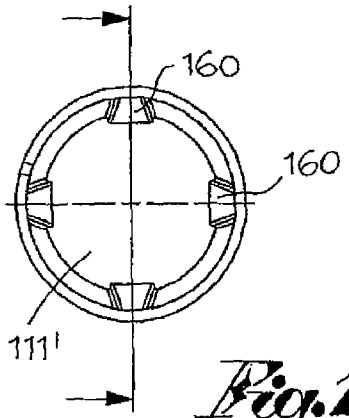
Figure 10B:
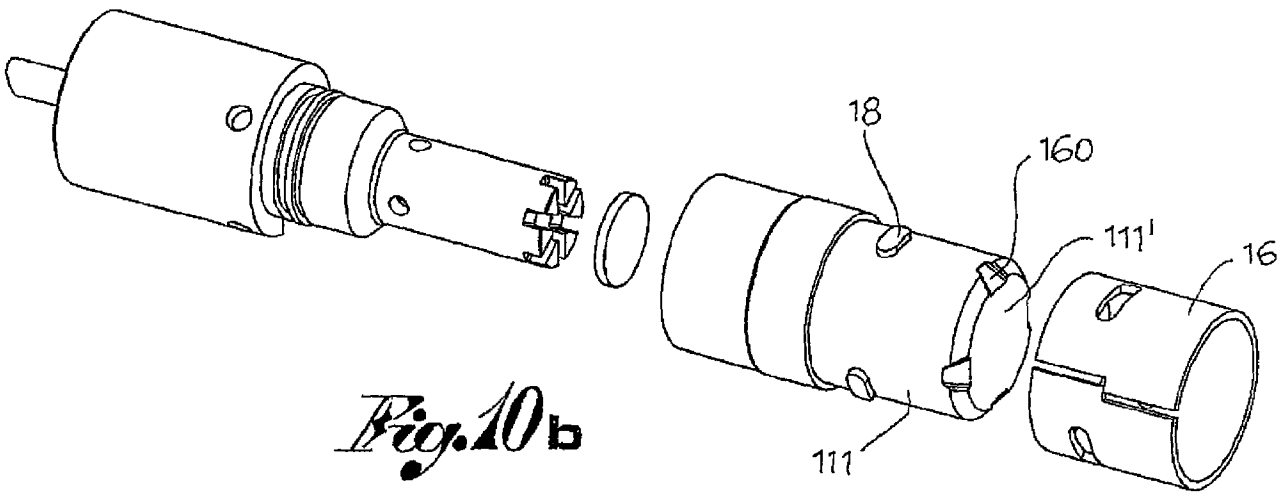

The piston illustrated in FIGS. 10, 10*a* and 10*b* is similar to that of FIG. 4, since it comprises a band 16 retracted relative to a truncated-cone head 111' of the piston body 111, and a plurality of radial channels 160 obtained on the side surface of said head 111'. In this case, however, band 16 is not seated in a special seat communicating with channels 160, but is held into position only by the coupling between projections 18 and slots 17. To make the liquid metal penetrate, through channels 160, underneath band 16, such channels 160 do not extend to the truncated-cone head 111' only but end, at the back, in the cylindrical zone of body 111 on which band 16 is mounted. Also in this case, therefore, the metal that solidifies under the band tends to compensate the wear thereof radially pushing it and keeping it always adhering to the container wall.

Figure 11:
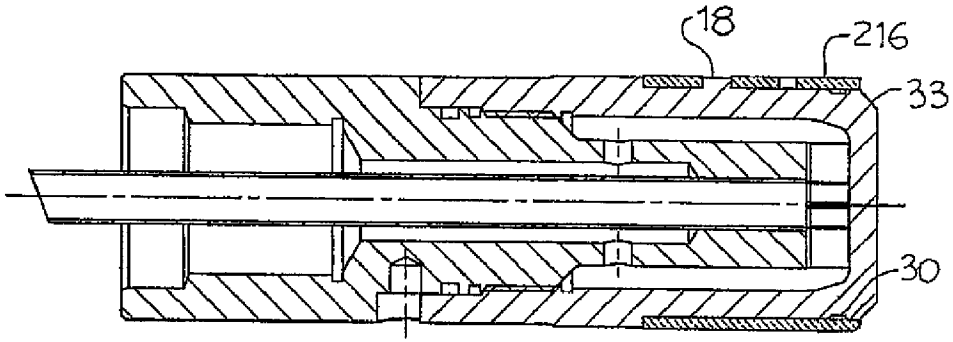
FIGS. 11 and 11*a* show an axial section and an exploded perspective view of a piston in another embodiment.
Figure 11A:
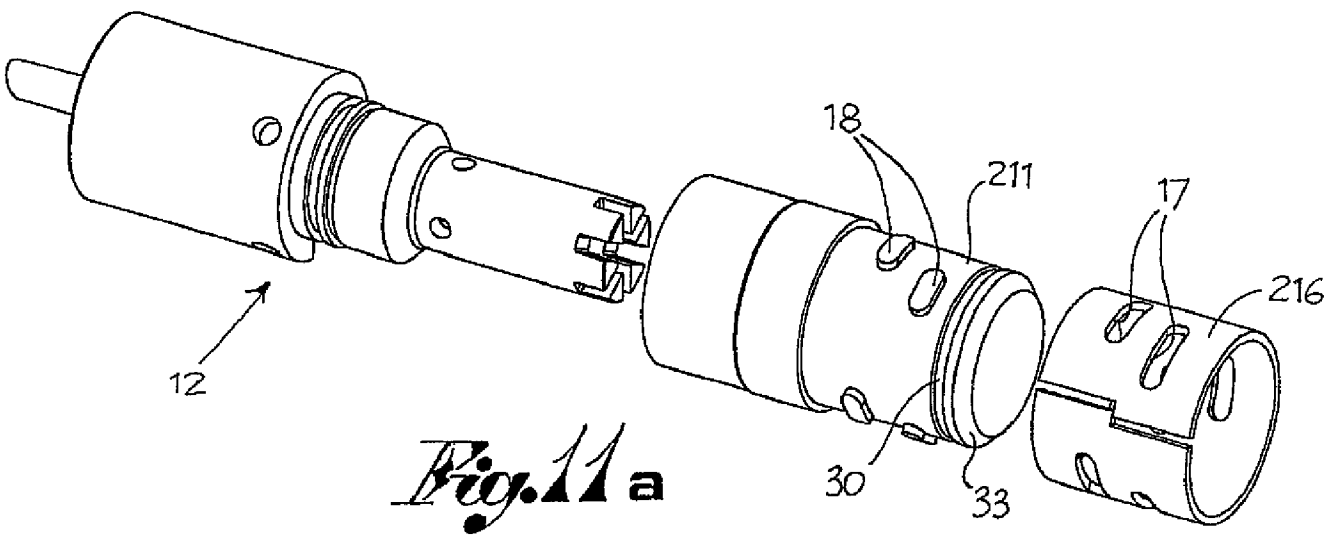

In one embodiment shown in FIGS. 11 and 11*a*, the sealing band 216 and the piston body 211 have, along the axial direction, two orders of slots 17 and projections 18 for further increasing the axial and angular locking of the band.

Figure 12:
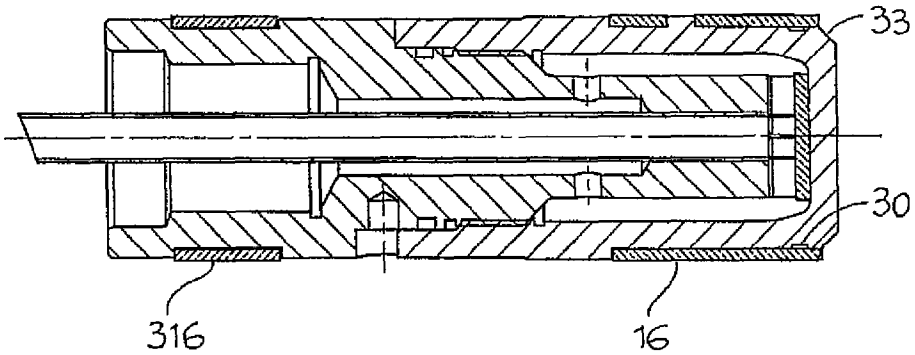
FIGS. 12 and 12*a* show an axial section and an exploded perspective view of a piston in a further embodiment.
Figure 12A:
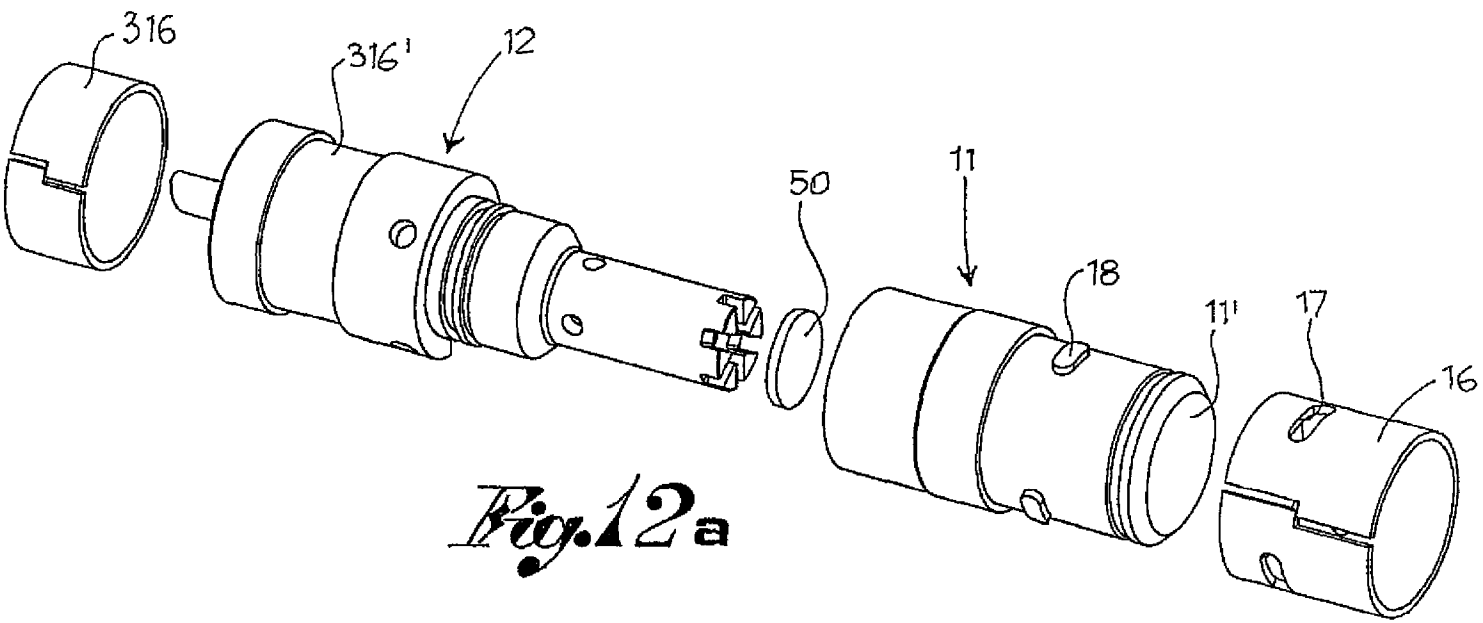

The piston of FIGS. 12 and 12*a* comprises, like that shown in FIG. 4, two parallel sealing bands 16, 316, front and back respectively. In this case, the back band 316 is mounted in a relevant seat 316' obtained in the support plug 12, rather than on body 11. This allows further spacing the two bands and thereby increasing the piston coaxiality relative to the container chamber and the guide effect of the bands. Such configuration is especially suitable for vacuum die-casting.

Figure 13:
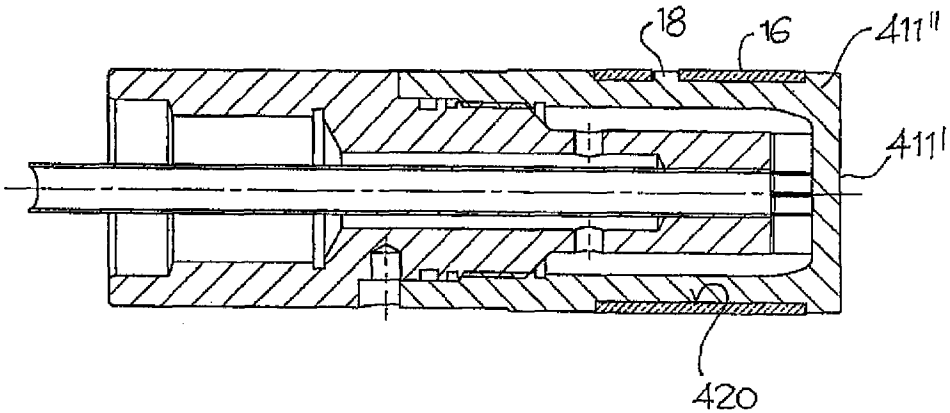
FIGS. 13 and 13*a* show an axial section and an exploded perspective view of a piston in another embodiment.
Figure 13A:
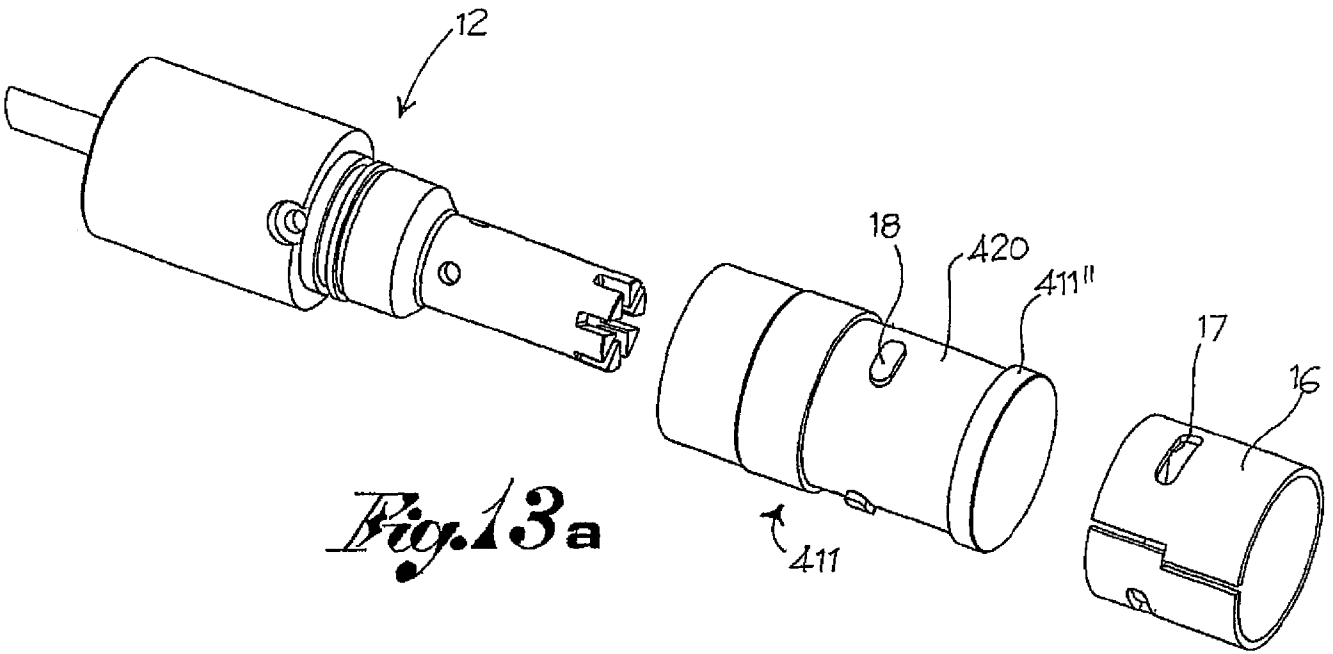

According to one embodiment illustrated in FIGS. 13 and 13*a*, the sealing band 16 is seated in a seat 420 obtained in retracted position relative to head 411' of the piston body 411. In other words, body 411 has a cylindrical end portion 411" that along with the most retracted band 16, contributes to sealing on the wall of the chamber of container 60. This can be obtained by making such cylindrical end portion 411" with a tolerance lower than the fluidity of metal at the liquid state (that in the case of aluminium is about one tenth).

Figure 14:
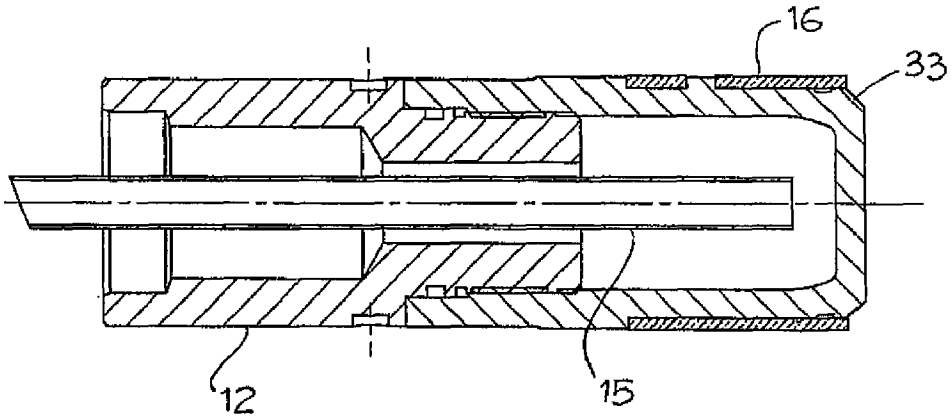
FIGS. 14 and 14*a* show an axial section and an exploded perspective view of a piston in a further embodiment.
Figure 14A:
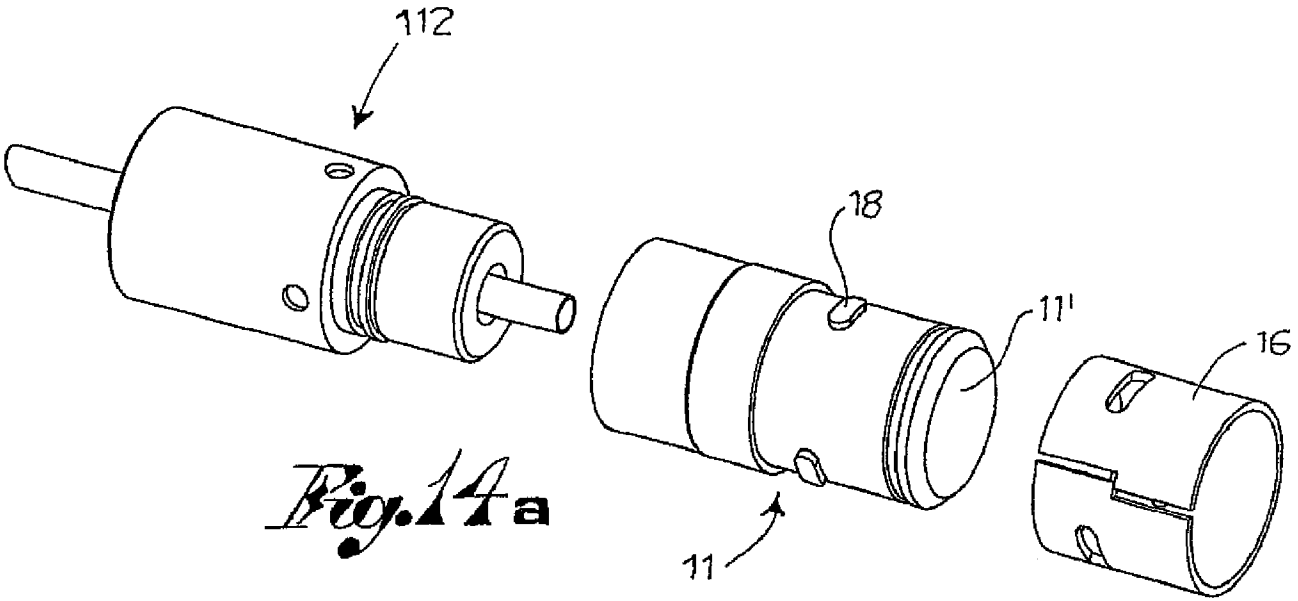
Figure 15:
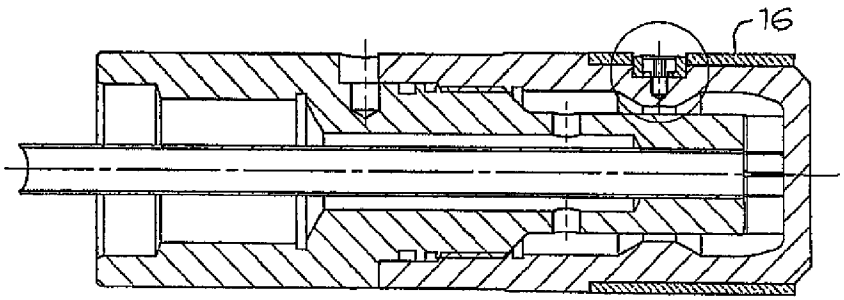
FIGS. 15 and 15*b* show an axial section and an exploded perspective view of a piston in another embodiment.
Figure 15A:
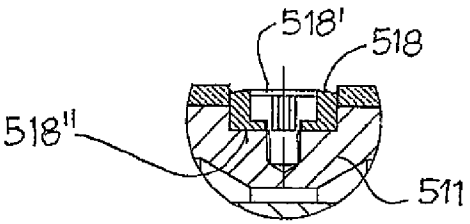
FIG. 15*a* shows an enlarged view of the circled detail in FIG. 15.
Figure 15B:
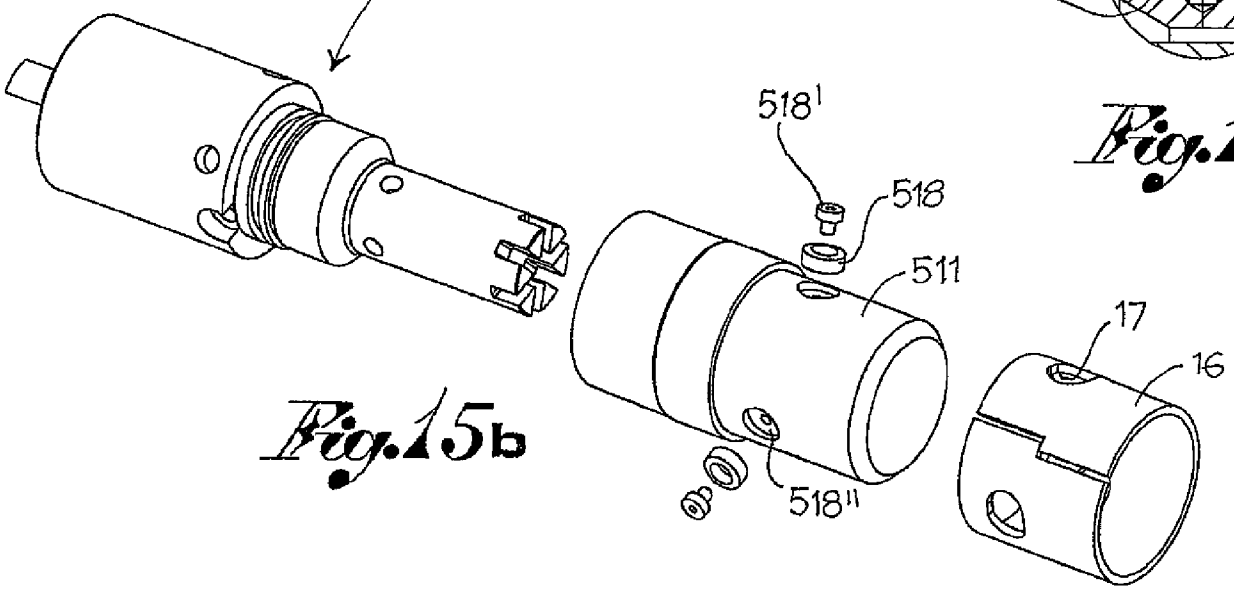

According to one embodiment illustrated in FIGS. 14 and 14*a*, the piston body 11 is mounted on a plug 112 with simplified structure, without the reduced diameter portion 13. The plug portion 112 is crossed by the cooling duct 15 that extends up in the proximity of the piston head. Such plug structure 112 can be used in particular for reduced diameters, where there are no particular cooling problems.

In accordance with one embodiment illustrated in FIGS. 15, 15*a*, 15*b*, 16, 16*a* and 16*b*, projections 518, 618 of the piston body 511, 611 are shaped as fitted blocks fixed to the body, not integral therewith. For example (FIGS. 15, 15*a* and 15*b*), blocks 518 are removably connected to body 511 by screws 518'. Each block 518 has a seating recess for the screw head 518', so that this does not protrude at the level of the sealing band 16. Moreover, each block 518 is seated in a respective seat 518" obtained in the piston body 511. At least at the level of the holes for screws 518', the latter may have an increased thickness zone.

In this case, if the blocks become excessively worn impairing the locking of band 16, they can be removed and replaced.

In the example of FIGS. 16, 16*a* and 16*b*, blocks 618 are inserted in special seats 618' obtained in body 611, passing through openings 617 obtained in band 616. Afterwards, the edge of openings 617 that protrudes in height relative to the blocks is riveted or caulked on top of the block, locking it into position. This embodiment solution has the advantage that it is not necessary to provide increased thickness zones in the piston body.

In the case of fitted blocks 518, 618, they can have a circular or square section.

According to a further aspect of the invention, again illustrated in FIGS. 16, 16*b*, the sealing band 616 is shaped as a cap that covers not only the side cylindrical surface of body 611, but also head 611'. In the practice, if made of a copper alloy like the sealing bands, the cap simulates the effect of a copper piston that for certain applications and in certain conditions, is preferable to a steel piston with copper sealing band.

Advantageously, cap 616 is obtained by spinning so as to be more resistant than a cap made by extrusion.

The embodiment with fitted blocks 518, 618 is particularly suitable for the use of the closed cap band 616 since it is possible to first axially fit band 616 on the piston body, and then the locking blocks are applied.

It is clear that the cap band 616 may be applied to the piston also in a different way, for example by screwing, mechanical deformation, etc.

It should be noted that the system for locking the sealing bands on the piston proposed herein allows choosing and maintaining the optimum position of the band based on the features of the machine and of the die.

Figure 5:
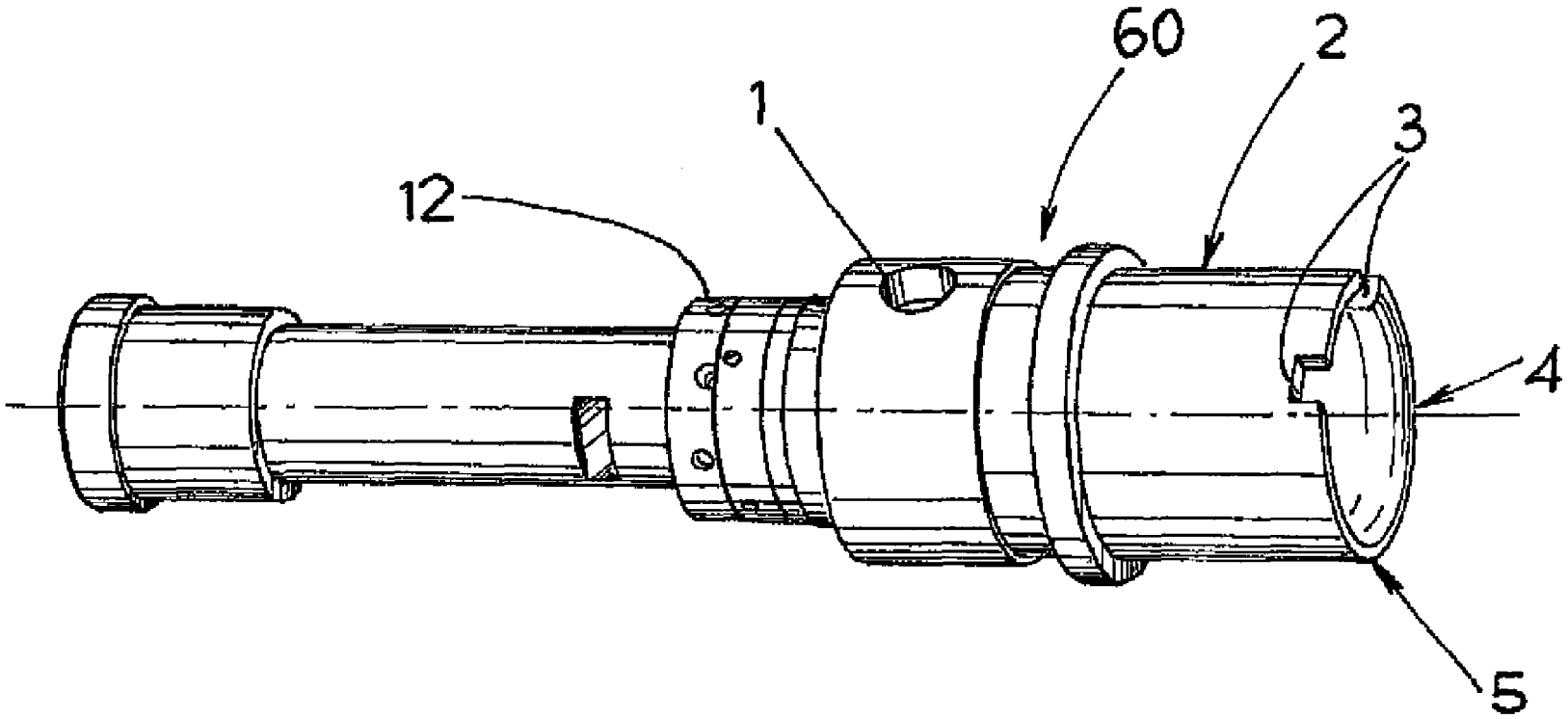
FIG. 5 shows a perspective view of the piston of FIG. 4 in a retracted position relative to the container of a press.
Figure 6:
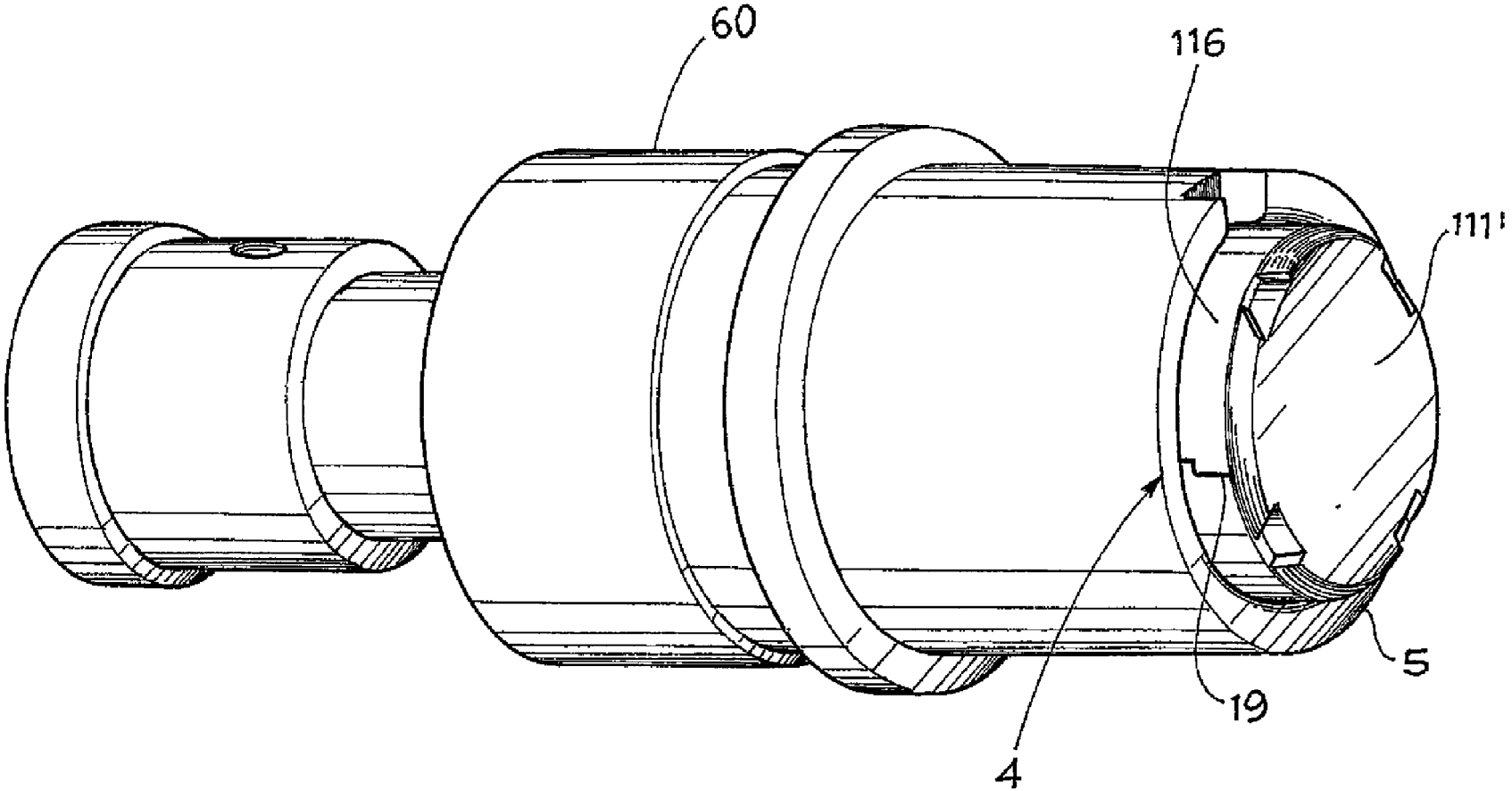
FIG. 6 shows the piston of FIG. 4 in a forward position in the container.

For example, as said hereinbefore, when the points wherein the liquid metal exhibits the greater fluidity are known, for example zones 1, 2 and 3 of container 60 at the inlet, at the top side and at the starting points of the casting branches, respectively, it is possible to arrange the band so that the step-wise split thereof 19 is far from said points, for example in zones 4 and 5 indicated in FIGS. 5 and 6.

Advantageously, moreover, the sealing band width is at least equal to the width, measured in axial direction, of splits 3 of the casting branches. In this way, in fact, the metal into the feedhead does not reach the piston portion upstream of the band and this is therefore prevented from getting damaged or even removed from the piston.

Moreover, the axial and angular locking of the band is not localised in a single point but is distributed along the piston and the band circumference, and is therefore solid and safe, and is obtained by the same coupling means between the piston body and the band.

It is evident that a man skilled in the art may make several changes and adjustments to the piston according to the present invention in order to meet specific and incidental needs, all falling within the scope of protection of the invention as defined in the following claims.

For example, combinations of the described embodiments may be envisaged. In particular, the presence of the annular channel 30 in the proximity of the piston head and of the copper pad 50, and the totally symmetric shape of the sealing band, may be elements common to all embodiments (of course where possible).

What is claimed is:

1. Piston for cold chamber die-casting machines comprising a body and at least one sealing band mounted around said body, wherein said body and said band are provided with coupling means suitable for concurrently obtaining both an angular locking and an axial locking of the band to the piston body, wherein at least two openings are obtained in each sealing band wherein respective radial projections that extend from the piston body engage.

2. Piston according to claim 1, wherein said openings are shaped as slots, each radial projection being configured as a circular sector.

3. Piston according to claim 1, wherein the openings, and as a consequence the piston projections, are arranged symmetrically relative to the main axis (X) of the band and of the piston.

4. Piston according to claim 1, wherein if N is the number of openings and of projections, said projections and openings are spaced from one another by angles equal to 360°/N.

5. Piston according to claim 1, wherein the openings are through openings, and wherein the projections have a height not exceeding the band thickness, so as to not protrude from said openings.

6. Piston according to claim 5, wherein each opening has a greater passage section than the cross section of the respective projection so as to define an escape way for the excess liquid metal flown under the band.

7. Piston according to claim 1, wherein the piston body ends at the front with a head, and wherein the sealing band extends starting from an annular stop shoulder obtained on said body, up to said head.

8. Piston according to claim 1, wherein the sealing band ends at the front in retracted position relative to the piston body head, and is linked to said head by a conical surface.

9. Piston according to claim 1, comprising a front sealing band and a back band, parallel to the front band, for guiding and centering the piston.

10. Piston according to claim 9, wherein said back band is mounted on the piston body.

11. Piston according to claim 9, wherein the back band is mounted on the support plug.

12. Piston according to claim 1, wherein the piston body is mounted on a support plug, said plug having a front portion of smaller diameter so that a cooling chamber is comprised between the body and said front portion of the plug.

13. Piston according to claim 12, wherein the plug is axially crossed by a duct for a cooling fluid leading into said chamber.

14. Piston according to claim 12, wherein a copper pad is arranged between the front portion of the support plug and the piston body head suitable for increasing the cooling of said head.

15. Piston according to claim 1, wherein the piston body has a concave head.

16. Piston according to claim 1, wherein the sealing band is seated in an annular seat obtained in the piston body in retracted position relative to the head of said body, so that the body ends with a cylindrical end portion suitable for making a seal on the walls of the press container wherein the piston slides.

17. Piston according to claim 1, wherein the radial projections of the piston body are shaped as fitted blocks fixed to the body.

18. Piston according to claim 17, wherein said blocks are fixed by screws or screwed to the piston body.

19. Piston according to claim 17, wherein said blocks are inserted in special seats obtained in the piston body and are locked in said seats by riveting or caulking of the edge of the openings of the sealing band that projects in height above the blocks.

20. Piston according to claim 17, wherein the sealing band is shaped as a cap that covers both the side cylindrical surface of the piston body and the front surface thereof, or head.

21. Piston according to claim 20, wherein the cap band is obtained by spinning.

22. Piston according to claim 1, wherein the sealing band is symmetrical relative to a cross axis so as to be applicable to the piston body at both ends without distinction.

23. Piston according to claim 1, wherein in the proximity of the head, the piston body has an annular channel suitable for being covered by the sealing band when this is fitted on the piston body so as to retain the metal once it has solidified.

24. Piston according to claim 1, wherein the body is of steel.

25. Piston according to claim 1, wherein the at least one sealing band is of a copper alloy.

26. Piston for cold chamber die-casting machines comprising a body and at least one sealing band mounted around said body, wherein said body and said band are provided with coupling means suitable for concurrently obtaining both an angular locking and an axial locking of the band to the piston body, wherein the sealing band ends at the front in retracted position relative to the piston body head, and is linked to said head by a conical surface, and wherein in said conical surface there are obtained at least two radial channels suitable for making the metal at the liquid state flow from the piston body head under the sealing band.

27. Piston according to claim 26, wherein said radial channels at the back end in the cylindrical zone of the body on which the sealing band is mounted.

28. Piston according to claim 26, wherein the sealing band is seated in a respective annular seat obtained in the piston body, and wherein said channels are suitable for placing in fluid communication the bottom of said seat of the band with the piston body head.

29. Sealing band for a piston for cold chamber die-casting machines, comprising at least two openings suitable for being engaged by corresponding radial projections that extend from the piston body.

30. Sealing band according to claim 29, wherein the openings are through openings arranged symmetrically relative to the main axis (X) of the band.

31. Sealing band according to claim 29, shaped as a cap that covers both the side cylindrical surface of the piston body and a front surface thereof, or head.

32. Sealing band according to claim 31, wherein said cap is obtained by spinning.

* * * * *